US006349466B1

(12) United States Patent
Redler et al.

(10) Patent No.: US 6,349,466 B1
(45) Date of Patent: Feb. 26, 2002

(54) READY TO WIRE TERMINAL ASSEMBLY WITH VIBRATION RESISTANT CLAMPING SCREWS

(75) Inventors: Daniel S. Redler, Atlanta, GA (US); Jon D. Pickens, Duluth; Richard Hudson, Suwanue, both of GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 09/428,318

(22) Filed: Oct. 28, 1999

(51) Int. Cl.[7] ..... H01R 43/16

(52) U.S. Cl. ..... 29/825; 29/837; 29/854; 29/857; 29/883; 411/310; 411/311; 439/810; 439/931

(58) Field of Search ..... 361/622–627, 361/640–647; 439/98, 801–812, 813, 877, 882, 856, 709–733, 744, 736, 871; 411/301–311, 135, 188–190, 285, 263, 417, 427, 332, 271, 938, 436, 916, 929, 333–334; 72/88, 469, 299; 29/837, 854, 857, 884, 825, 842, 840

(56) References Cited

U.S. PATENT DOCUMENTS

| | | | | |
|---|---|---|---|---|
| 2,585,055 A | | 2/1952 | Thomas et al. | |
| 3,133,779 A | | 5/1964 | Stanback | |
| 3,346,835 A | | 10/1967 | Burniston | |
| 3,762,604 A | | 10/1973 | Shonerd | |
| 3,885,613 A | * | 5/1975 | Evans | 151/22 |
| 3,982,575 A | * | 9/1976 | Ollis et al. | 411/311 |
| 4,231,633 A | | 11/1980 | Luke et al. | |
| 4,236,778 A | | 12/1980 | Hughes et al. | |
| 4,258,607 A | * | 3/1981 | McKewan | 411/417 |
| 4,261,402 A | | 4/1981 | Stanaitis | |
| 4,343,529 A | | 8/1982 | Reavis, Jr. et al. | |
| 4,351,626 A | * | 9/1982 | Holmes | 411/311 |
| 4,432,682 A | * | 2/1984 | McKewan | 411/311 |
| 4,479,101 A | | 10/1984 | Checinski | |
| 4,536,823 A | * | 8/1985 | Ingram et al. | 361/346 |
| 4,603,376 A | | 7/1986 | Maier | |
| 4,661,031 A | * | 4/1987 | Heine | 411/263 |
| 4,734,002 A | * | 3/1988 | Holmes | 411/311 |
| 4,740,865 A | | 4/1988 | Barner | |
| 5,020,954 A | * | 6/1991 | Dreger | 411/403 |
| 5,041,026 A | | 8/1991 | Hansel | |
| 5,269,710 A | | 12/1993 | Donnerstag | |
| 5,340,253 A | * | 8/1994 | Stencel | 411/310 |
| 5,358,368 A | * | 10/1994 | Conlan et al. | 411/410 |

FOREIGN PATENT DOCUMENTS

| | | |
|---|---|---|
| DE | 931 359 | 8/1955 |
| GB | 1035453 | 4/1963 |

* cited by examiner

*Primary Examiner*—Leo P. Picard
*Assistant Examiner*—Michael Datskovsky

(57) ABSTRACT

A method of preventing vibration loosening of a clamping screw 26 of a circuit protection apparatus 10 is provided. The circuit protection apparatus 10 has a conductor receiving member 28 including a conductor receiving opening 40 for receiving an electrical conductor 46 therein. The conductor receiving member 28 has an aperture 42 extending from a surface 50 thereof into communication with the conductor receiving opening 40. An overall extent of the aperture 42 includes threads. The method provides a clamping screw 26 having a threaded shaft 50. The threaded shaft 50 has a surface feature 52 in the threads thereof near an end 54 of the shaft. The clamping screw 26 is inserted into the threaded aperture 42 until the surface feature 52 is in interference engagement with threads of the threaded aperture to hold the clamping screw in the threaded aperture, with the end 54 of the shaft being disposed to permit access to the conductor receiving opening 40 such that the clamping screw need not be backed-out from the threaded aperture to provide access to the conductor receiving opening 40.

7 Claims, 4 Drawing Sheets

READY TO WIRE TERMINAL ASSEMBLY WITH VIBRATION RESISTANT CLAMPING SCREWS

BACKGROUND OF THE INVENTION

The present invention relates to devices for the distribution of electric power and more particular to electrically connecting a wire or conductor to a terminal using a clamping screw.

Bus bars and neutral terminal bars of panel boards and similar electrical apparatus are often connected to the power supply wires or conductors by lugs and screws. When the panel board has a great number of circuits, a large number of lugs and screws are required. For example, a forty circuit panel board may require one-hundred and fifty or so screws. Conventionally, the electrical connection for securing a conductor to a neutral terminal bar is accomplished by providing a plurality of threaded apertures in the terminal bar. A bore is disposed transversely with respect to each threaded aperture. When making the electrical connections, the conductor is inserted into each bore and a clamping screw is inserted into the associated threaded aperture. The screw is then tightened to secure the conductor in the bore, making the electrical connection.

After the manufacture of an electrical device which includes a plurality of clamping screws which are intended to enable the future connection of the electrical conductors to the device by the end user, the screws are typically screwed all the way down into in their respective threaded apertures. Conventionally, the screws are factory torqued to generally 20 inch-pound which precludes subsequent loosening thereof by vibration during shipment and post-manufacture handling. The end user must back-out each screw from its respective threaded aperture a sufficient distance in order to enable the placement of the electrical conductor or wire through the bore. This is a significant inconvenience and is particularly time consuming when many such connections have to be made for each device. Furthermore, when the screws are factory torqued for shipping, it is difficult for the end user to loosen the screws, and it is possible to strip or even break a screw when backing the screw out of its threaded aperture.

Thus, a need exists for a device and method which ensures clamping screws, for making electrical connections, are secured properly during shipping of the device, yet do not need to backed-out by the end user prior to making the electrical connections.

SUMMARY OF THE INVENTION

An object of the invention is to fulfill the need referred to above. In accordance with the principles of the present invention, this objective is achieved by a method of preventing vibration loosening of a clamping screw of a circuit protection apparatus. The circuit protection apparatus has a conductor receiving member including a conductor receiving opening for receiving an electrical conductor therein. The conductor receiving member has an aperture extending from a surface thereof into communication with the conductor receiving opening. An overall extent of the aperture includes threads. The method provides a clamping screw having a threaded shaft. The threaded shaft has a surface feature in the threads thereof near an end of the shaft. The clamping screw is inserted into the threaded aperture until the surface feature is in interference engagement with threads of the threaded aperture to hold the clamping screw in the threaded aperture, with the end of the shaft being disposed to permit access to the conductor receiving opening, such that the clamping screw need not be backed-out from the threaded aperture to provide access to the conductor receiving opening.

In accordance with another aspect of the invention, a circuit protection apparatus includes a conductor receiving member having a conductor receiving opening for receiving an electrical conductor therein. The conductor receiving member has an aperture extending from a surface thereof into communication with the conductor receiving opening. An overall extent of the aperture includes threads. A clamping screw has a threaded shaft and the threaded shaft has a surface feature in the threads thereof near an end of the shaft. The clamping screw is disposed in the threaded aperture with the surface feature in interference engagement with threads of the threaded aperture to hold the clamping screw in the threaded aperture. In this position, the end of the shaft is disposed to permit access to the conductor receiving opening such that the clamping screw need not be backed-out from the threaded aperture to provide access to the conductor receiving opening. The clamping screw is constructed and arranged such that when the clamping screw is tightened, the surface feature will move from engagement with the threads and become more easily to tighten, and the end of the shaft will move into the conductor receiving opening.

In yet another aspect of the invention, a clamping screw is provided for clamping an electrical conductor of a circuit protection apparatus. The circuit protection apparatus has a conductor receiving member including a conductor receiving opening for receiving an electrical conductor therein. The conductor receiving member has an aperture extending from a surface thereof into communication with the conductor receiving opening. An overall extent of the aperture is threaded. The clamping screw comprises a threaded shaft having a surface feature in the threads thereof near an end of the shaft such that when the end of the shaft is inserted into the threaded aperture, the surface feature becomes engaged with threads of the threaded aperture in an interference manner.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

Preferred embodiments of the invention are described in greater detail herein below with reference to the drawings wherein.

DETAILED DESCRIPTION OF THE PREFERRED EMBODIMENTS

Figure 1:
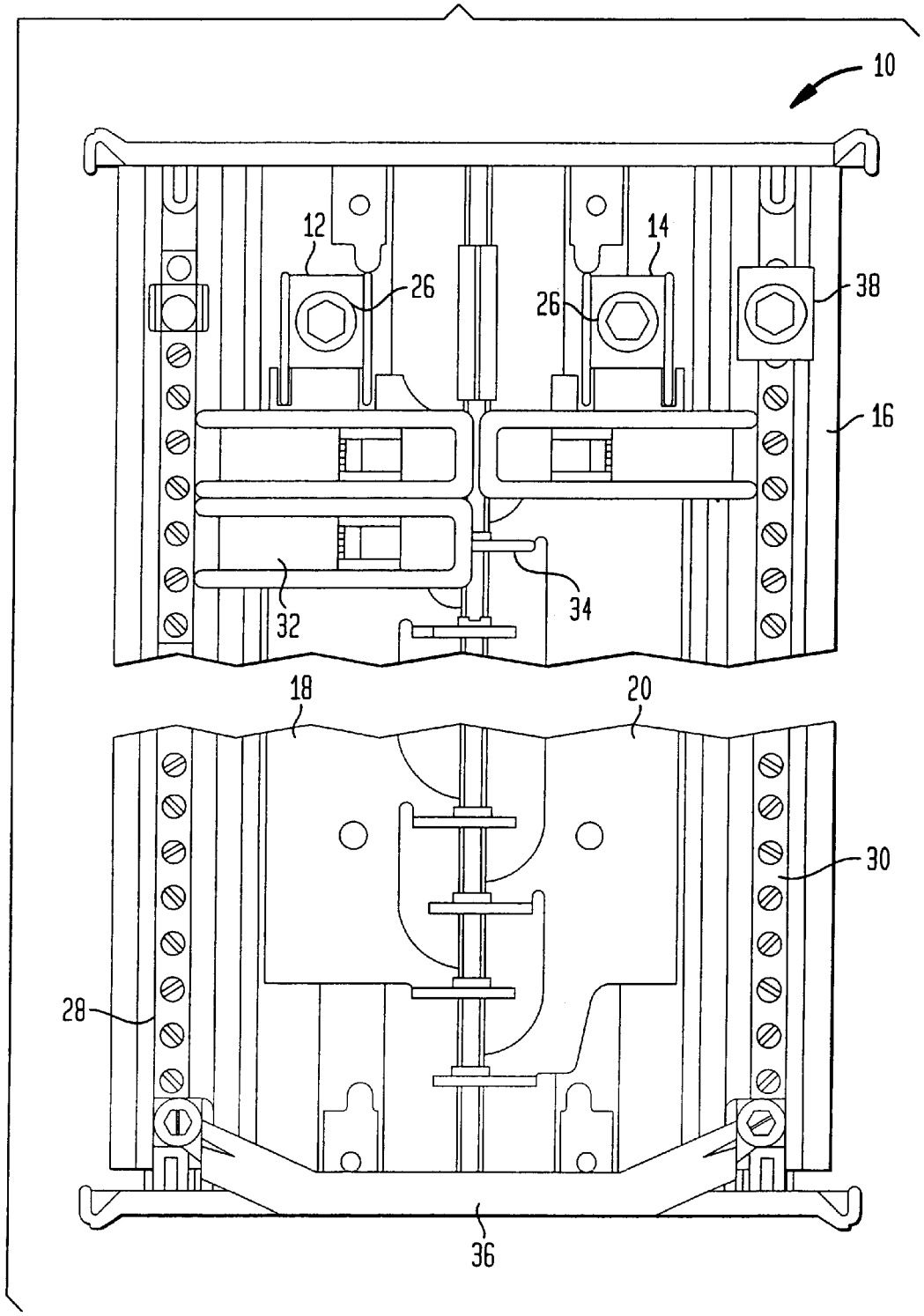
FIG. 1 is a front view of a panel board showing neutral and main line lugs, single pole circuit breakers, neutral terminal bar, and screw connections, provided in accordance with the principles of the present invention.

With reference to FIG. 1 an electric panel board, such as shown and described in U.S. Pat. No, 4,536,823 which is hereby incorporated into the present specification by reference, is shown generally indicated at 10. In the conventional manner, a pair of main line lugs 12 and 14 are engaged with a base pan 16 and are in direct electrical contact with bus bars 18 and 20. In the conventional manner, an opening is provided in lug 12 and in lug 14 for passing a main-line wire (not shown) therethrough and for electrically connecting the lugs to either a bus bar or a circuit breaker. Each of lugs 12 and 14 is provided with a clamping screw 26 which engages a threaded passageway in the lug and which provides a means for making electrical contact between the main-line wire, and either a circuit breaker or a bus bar. When electrical leads are attached to lugs 12 and 14, a voltage may be applied directly to bus bars 18 and 20.

Panel board 10 further includes a pair of conductor receiving members in the form of neutral terminal bars 28 and 30 engaged with the base pan 16. A single pole circuit breaker 32 is mounted on the base pan 16 and bus 18 or 20 through stab 34. Each circuit breaker 32 is electrically connected to neutral terminal bars 28 or 30. Neutral terminal bars 28 and 30 are electrically joined by neutral element 36 so that a single neutral lead (not shown) attached to neutral lug 38 may provide a neutral connection for all single-pole circuit breakers 32 used in panel board 10.

Figure 2:
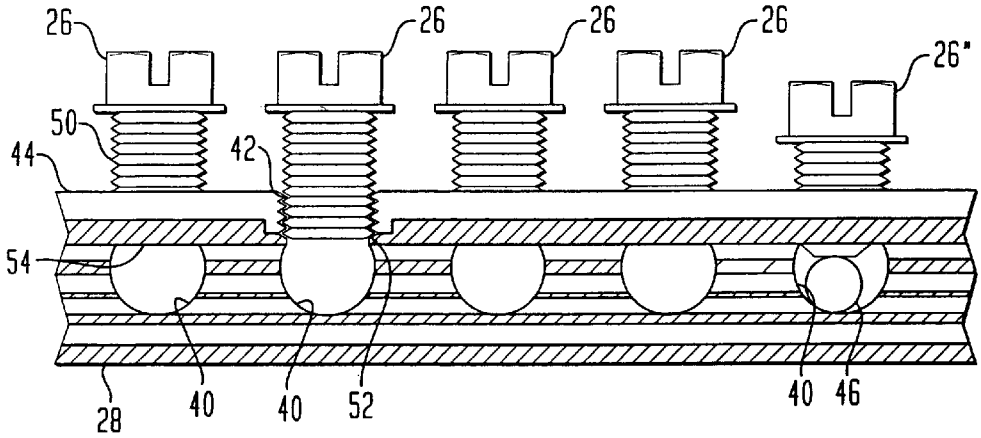
FIG. 2 is a side view of a portion of the neutral terminal bar of FIG. 1 employing screw connections of the invention.

A portion of the neutral terminal bar 28 is best shown in FIG. 2. Terminal bar 30 is generally identical to bar 28 and thus, the description will be directed to terminal bar 28. Terminal bar 28 is conventional and may be of the type described in U.S. Pat. No. 4,231,633 which is hereby incorporated into the present specification by reference. The terminal bar 28 is provided with a plurality of conductor receiving members in the form of bores 40 extending transversely through bar 28. Communicating with each bore 40 is an individual threaded aperture 42 extending from surface 44 of the terminal bar 40 to the associated bore 40. In other words, the overall extent of the threaded aperture 42 is threaded. Each threaded aperture 42 receives an associated clamping screw 26 for engaging and holding a conductor 46 received in the associated bore 40.

After manufacture of the panel board 10, it is desirable to insert all clamping screws 26 into the associated threaded apertures 42 prior to transporting the panel board to the end user. It is important that the screws 26 are held in the threaded apertures 42 and do not become separated from the threaded apertures 42 due to vibration during transport.

Figure 3:
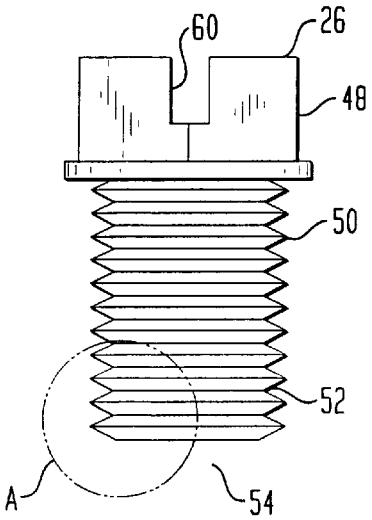
FIG. 3 is a front view of a screw employed in the screw connection of FIG. 2.
Figure 4:
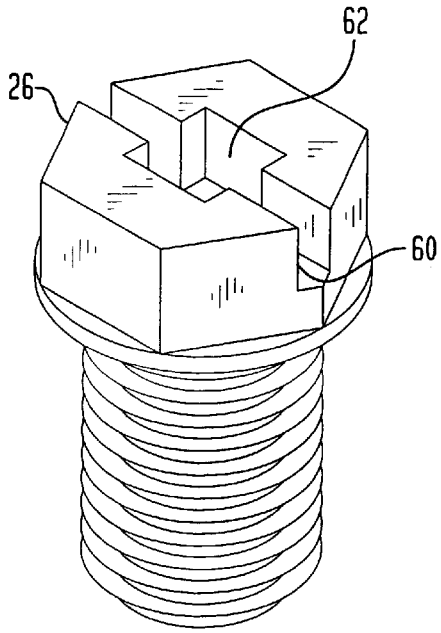
FIG. 4 is a perspective view of the screw of FIG. 3.
Figure 5:
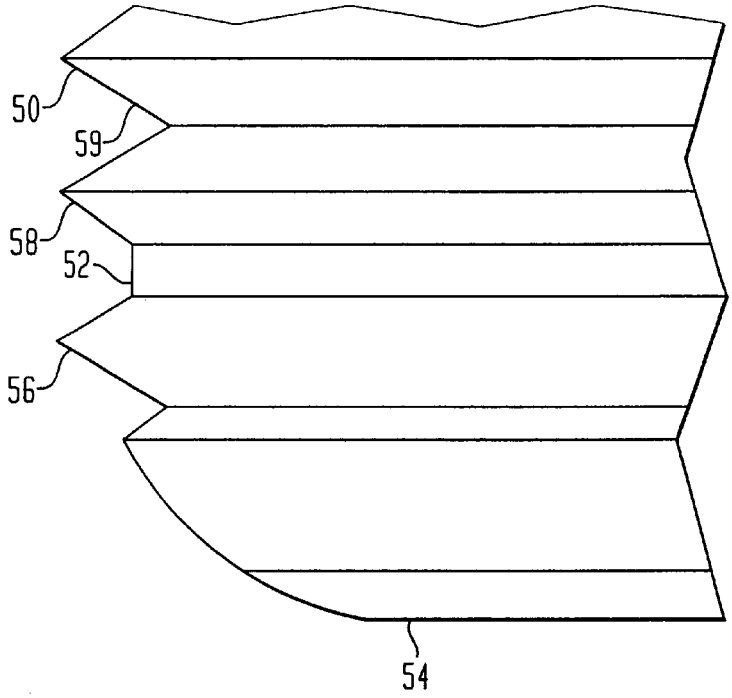
FIG. 5 is an enlarged view of the portion encircled at A in FIG. 3.
Figure 7:
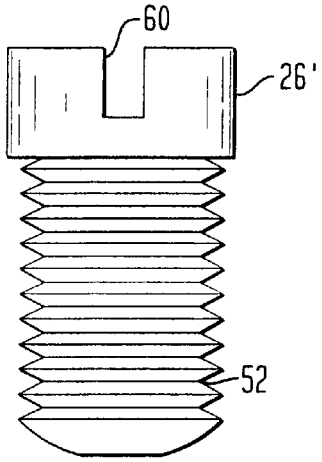
FIG. 7 is a front view of a screw of a second embodiment of the invention.
Figure 8:
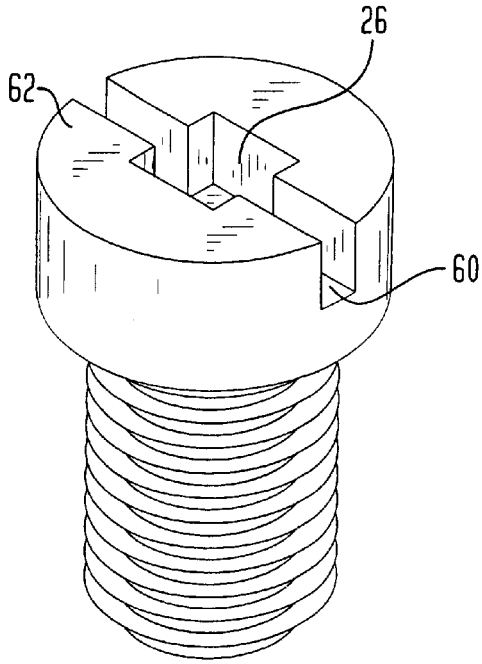
FIG. 8 is a perspective view of the screw of FIG. 7.

Thus, in accordance with the principles of the present invention a novel clamping screw 26 is provided. As best shown in FIG. 3, each clamping screw 26 has a head 48 and a threaded shaft 50. Each clamping screw 26 is preferably a machine screw. A surface feature 52 is provided in the threads of the threaded shaft 50. In the illustrated embodiment and best shown in FIG. 5, the surface feature 52 comprises an arcuate wall member between adjacent threads 56 and 58 of the threaded shaft 50. The wall member 52 defines the bottom of a trough between threads 56 and 58 which is shallower than the troughs 59 of all other threads so as to cause an interference engagement with threads of the threaded aperture 42. Thus, the wall member 52 may be considered to be an oversize thread. In particular, the wall member 52 is provided between a portion of the first and second full threads at end 54 of the threaded shaft 50. In the illustrated embodiment, the head 48 is hexagonal to receive a drive tool. In addition, the head includes a slot 60 for a receiving a screwdriver and has a generally square recess 62 (Robertson head) for receiving a square drive. Alternatively, as shown in FIGS. 7 and 8, the screw 26' may include only a slot 60 and a square recess 62. It is within the contemplation of the invention to provide the screw 26 with only a slot, only a square recess, or only a hex-head. Furthermore, the head 48 may be omitted and the drive feature may be incorporated into the shaft 50 of the screw 26. It is noted that the clamping screws 26 in the lugs 12 and 14 of FIG. 1 are configured in accordance with invention, but may be of a size different from the clamping screws 26 employed in the terminal bars 28 and 30.

In accordance with the invention and with reference to FIG. 2, each clamping screw 26 is inserted into an associated threaded aperture 42 until the surface feature 52 is in interference engagement with threads of the threaded aperture 42 to hold the screw 26 in the threaded aperture 42. The screws 26 are now resistant to vibration and will not easily become disengaged with the threaded apertures 42 during transport. It is evident when this interference engagement occurs since frictional resistance to the torquing of the screw 26 is experienced by the user. Since the surface feature 52 is near end 54 of the shaft 50, the shaft end 54 is disposed to permit access to the conductor receiving opening 40 such that the clamping screw 26 need not be backed-out from the threaded aperture 42 to provide access to the conductor receiving opening 40. Thus, the end user can simply insert an electrical conductor 46 into the conductor receiving opening then torque the clamping screw 26 to move the surface feature 52 beyond engagement with the threads of the threaded aperture 42. Once the surface feature 52 is no longer engaged, the screw moves more easily to engage the electrical conductor 46, as shown by clamping screw 26" in FIG. 2.

Figure 6:
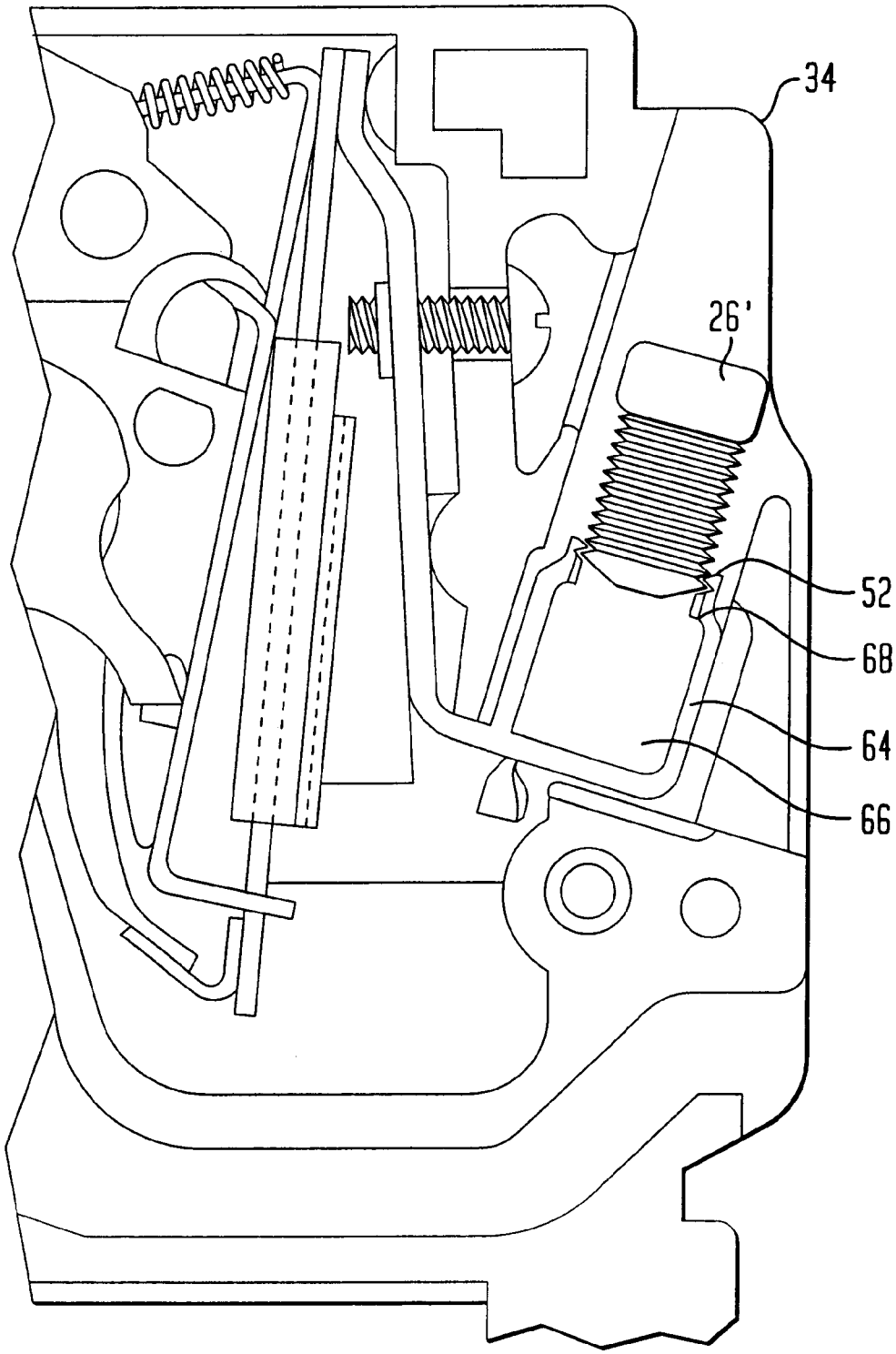
FIG. 6 is a side view of a portion of a circuit breaker with a conductor receiving member employing a screw connection in accordance with the principles of the invention.

With reference to FIG. 6, the clamping screw 26 or 26' may also be employed in a conventional circuit breaker 34 of the type shown and described in U.S. Pat. No. 4,479,101 which is hereby incorporated into the present specification by reference. This is one of the many different circuit breakers that can be employed as the circuit breaker 34 shown in the electric panel board depicted in FIG. 1. As is typical for most circuit breakers, a strap or conductor receiving member 64 (which functions in part as the circuit breaker load lug) includes a conductor receiving opening 66 defined by the strap 64. A threaded aperture 68 communicates the conductor receiving opening 66. A clamping screw 26' is inserted into the threaded aperture 68 so that the surface feature 52 is in interference engagement with the threads of the threaded aperture 68. A conductor (not shown) may then be inserted into the opening 66 without backing-out screw 26' and the screw 26' may be tightened to clamp onto the conductor.

Thus, the clamping screws 26 or 26' of the invention are applicable to electrical connections in a neutral terminal bar, circuit breakers, main-line or neutral lugs or any other device which requires a screw-in type terminal. Since the screws 26, 26' need not be backed-out by the end user to install the conductor, the installation labor is reduced by fifty percent and there is less chance of damaging the screws 26, 26' or threaded apertures 42. In addition, since the surface feature 52 is not in engagement with the threads of the threaded aperture 42 while clamping on the conductor 46, the torque of the conductor connection is not affected.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A method of preventing vibration loosening of a clamping screw of a circuit protection apparatus, the circuit protection apparatus having a conductor receiving member including a conductor receiving opening for receiving an electrical conductor therein, the conductor receiving member having a threaded aperture extending from a surface thereof into communication with the conductor receiving opening, an overall extent of the aperture including threads, the method including:

providing a clamping screw having a threaded shaft;

providing an interference feature; and inserting said clamping screw into said threaded aperture such that the interference feature is in interference engagement between the threads of said clamping screw and threaded aperture to hold said clamping screw in said threaded aperture, with an end of said threaded shaft being disposed to permit access to said conductor receiving opening such that the clamping screw need not be backed-out from the threaded aperture to provide access to the conductor receiving opening, said interference feature being configured such that torque required to rotate said clamping screw decreases when said clamping screw moves into said conductor receiving opening.

2. The method according to claim 1, wherein said interference feature is a surface feature on the threads of said clamping screws near the end of said threaded shaft.

3. The method according to claim 2, further including:

inserting an electrical conductor into said conductor receiving opening; and torquing said clamping screw to move said surface feature beyond engagement with the threads of the threaded aperture so that the end of said shaft engages the electrical conductor, wherein said clamping screw is provided such that the surface feature is in the form of an arcuate wall member between adjacent threads of said threaded shaft, said arcuate wall member defining a bottom of a trough which is shallower than all other troughs of the threaded shaft.

4. The method according to claim 1, wherein said circuit protection apparatus is a circuit breaker panel board and said conductor receiving member is a terminal bar having a plurality of conductor receiving apertures and associated threaded apertures, the method provides a plurality of clamping screws with one clamping screw being disposed in an associated threaded aperture.

5. The method according to claim 3, wherein said panel board includes a lug defining a conductor receiving member, the method provides a clamping screw disposed in the threaded aperture of said lug.

6. The method according to claim 1, wherein said circuit protection apparatus is a circuit breaker and said conductor receiving member is a lug including said conductor receiving aperture and associated threaded aperture therein, the method provides said clamping screw disposed in said threaded aperture of said lug.

7. A method of preventing vibration loosening of a clamping screw of a circuit protection apparatus, the circuit protection apparatus having a conductor receiving member including a conductor receiving opening for receiving an electrical conductor therein, the conductor receiving member having an aperture extending from a surface thereof into communication with the conductor receiving opening, an overall extent of the aperture including threads, the method including:

providing a clamping screw having a threaded shaft, said clamping screw being configured to be received by said threaded aperture; and inserting said clamping screw into said threaded aperture until said clamping screw is in interference engagement with threads of said threaded aperture to hold said clamping screw in said threaded aperture, with the end of said shaft being disposed to permit access to said conductor receiving opening such that the clamping screw need not be backed-out from the threaded aperture to provide access to the conductor receiving opening, said clamping screw and said threaded aperture being configured such that torque required to rotate said clamping screw decreases when said clamping screw moves into said conductor receiving opening.

* * * * *